US010105823B1

(12) United States Patent
Leiseca et al.

(10) Patent No.: US 10,105,823 B1
(45) Date of Patent: Oct. 23, 2018

(54) DENTAL TOOL SHARPENING FIXTURE ADAPTER

(71) Applicants: Cynthia B. Leiseca, Fernandina Beach, FL (US); Remberto Leiseca, Fernandina Beach, FL (US)

(72) Inventors: Cynthia B. Leiseca, Fernandina Beach, FL (US); Remberto Leiseca, Fernandina Beach, FL (US)

( * ) Notice: Subject to any disclaimer, the term of this patent is extended or adjusted under 35 U.S.C. 154(b) by 19 days.

(21) Appl. No.: 15/482,088

(22) Filed: Apr. 7, 2017

(51) Int. Cl.
*B24D 15/06* (2006.01)

(52) U.S. Cl.
CPC ..... *B24D 15/06* (2013.01)

(58) Field of Classification Search
CPC ..... B24D 15/06
USPC .... 451/555, 461, 552, 557, 558, 57–58, 462
See application file for complete search history.

(56) References Cited

U.S. PATENT DOCUMENTS 1,991,034 A * 2/1935 Stella ..... B24D 15/08 451/555
2,288,407 A * 6/1942 Lada ..... B43L 23/006 15/118
2,716,850 A * 9/1955 Reitzes ..... B24D 15/06 451/382
2,804,732 A * 9/1957 Brockley ..... B24D 15/08 403/334
4,617,765 A * 10/1986 Weiler ..... B24D 15/00 451/515
4,918,871 A * 4/1990 Widmann ..... A61L 9/12 144/346
5,487,693 A * 1/1996 Prusaitis ..... B24B 3/605 451/45
5,505,656 A * 4/1996 Moore ..... A61C 3/00 451/540
5,584,691 A * 12/1996 Domenella ..... B24B 3/605 433/141
5,879,229 A * 3/1999 Anderson ..... B24D 15/066 451/523
7,104,896 B2 * 9/2006 Wood ..... A63D 5/023 473/106
8,764,522 B2 * 7/2014 Pascoe ..... B24D 15/02 451/45
2005/0142992 A1 * 6/2005 Kawata ..... B24B 3/605 451/164
2009/0203301 A1 * 8/2009 Viscomi ..... B24D 15/084 451/451

* cited by examiner

*Primary Examiner* — George Nguyen
(74) *Attorney, Agent, or Firm* — William Hollimon

(57) ABSTRACT

An adapter for a fixture for sharpening dental instruments has an engagement arm for connecting to the fixture and for creating a holding space for different width sharpening stones, a bearing shelf for supporting different width sharpening stones, and a base member for supporting the adapter when connected to the fixture.

9 Claims, 3 Drawing Sheets

DENTAL TOOL SHARPENING FIXTURE ADAPTER

BACKGROUND OF THE INVENTION

1. Field of the Invention

This invention relates to the field of manual tool sharpening devices and methods, and more particularly to an adapter to a fixture for positioning and holding sharpening stones (abrasive surfaces) for the sharpening of dental instruments.

2. General Background

Dental tools often contain rounded working surfaces which require maintenance sharpening to maintain their functionality. Thus, sharpening the working surfaces of a typical dental instrument is far more complicated than sharpening a typical kitchen knife.

Related art sharpening devices are generally either manually actuated or employ motorized actuation. Manually actuated devices include freehand devices which generally do not guide the tool angle relative to the abrasive surface, thus making freehand sharpening undesirable because of the high probability of incorrect sharpening and damage to the tool itself. Other sharpeners of this type include protractors or other angle gauges to assist in maintaining the correct sharpening angle between the tool and the sharpening stone. However, again these tools do not constrain or guide the tool against the sharpening stone.

Another related art sharpening guide approach are devices that clamp or hold the dental tool as the tool is moved in relation to the sharpening stone. This approach, however, results in planar sharpening which destroys the curved surfaces required on dental tools. Machine sharpening, most importantly, suffers from the disadvantage of too much material removal, and resulting damage to dental tools.

Finally, dental tools must be sterilized between uses. This is typically accomplished at soak temperatures of around 275 degrees Fahrenheit. If a tool needs to be sharpened during a procedure, the sharpener itself must be sterilized, or the tool has to be resterilized (thus making the sharpening of tools during a procedure impractical).

BRIEF SUMMARY OF THE INVENTION

The present invention is an adapter creating an improved fixture that enables dental technicians to effectively sharpen a variety of dental instruments. The fixture holds at least one dental sharpening stone at a proper angle for sharpening dental instruments and provides a support beam for the fulcrum (ring) finger of the clinician to stabilize and control the blade of the instrument against the sharpening stone. The improvement includes an adapter that allows for the use of sharpening stones in a variety of widths. Currently, prior art sharpening systems include only a single width sharpening stone. However, for some dental instruments, the single width sharpening stone is not the optimal width for sharpening that instrument. Thus, there is a need for a sharpening fixture that accommodates a variety of sharpening stone thicknesses so that the sharpening fixture is optimized to sharpen a larger variety of dental instruments.

Preferably, the fixture is extruded in a single piece and is formed from aluminum, or other non-reactive metal that is suitable for extruding. Alternatively, the fixture may be formed from a non-porous plastic material that is capable of withstanding autoclave sterilization. Similarly, the adapter fixture is extruded in a single piece and is formed from aluminum, or other non-reactive metal that is suitable for extruding. Alternatively, the adapter may be formed from a non-porous plastic material that is capable of withstanding autoclave sterilization.

The prior art fixture includes a top horizontal platform which acts a fulcrum for a technicians hand/finger in the sharpening process. This platform is preferably rectangular in shape. Extending from the long ends of the platform are two support legs. These support legs extend at a first angle downward. Each support leg terminates in a lower horizontal section, or base, which creates a pair of bearing surfaces for supporting the fixture when placed on a work surface. Each lower horizontal section further includes a short riser that extends upward from the lower horizontal section, parallel to the associated support leg and serves as a sharpening stone support.

The space between the riser and the support leg creates an angled holding space which can accommodate a sharpening stone of various sizes, but only a single width. The angle of the support legs is predetermined such that the sharpening stone that may be placed in each holding space is supported by a support leg at an optimum angel for tool sharpening.

The improvement of the present invention includes an adapter that includes an engagement arm sized to fit into the angled holding space and further including a shelf suitable for supporting a sharpening stone, as well as a support leg and base. Once placed the adapter allows for the use different thickness stones, which facilitates the sharpening of a wider variety of dental tools In use, a dental technician inserts that adapter into one of the angled holding spaces of the fixture, selects the stone based on the thickness desired, balances a finger on the top platform support beam, and uses it as a fulcrum to guide the instrument cutting surface over the sharpening stone. In this method, the stone remains still and the instrument is moved over the stone. The technician can see the cutting edge as it makes contact with the stone, thereby increasing the sensitivity and accuracy of the sharpening process, and best preserving the curved surfaces typically found on dental tools.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein.

REFERENCE NUMBERS INCLUDED IN THE DRAWINGS

The below table provides a ready reference for the reference numbers used in the appended drawings and in this specification:

| Ref. No. | Description | Ref. No. | Description |
|---|---|---|---|
| 100 | Fixture | 101 | Standard stone |
| 201 | Adapter | 202 | Thin stone |
| 301 | Arc | 302 | Vertical axis |
| 303 | Support beam | 304 | Angled leg |
| 305 | Base | 306 | Stone support |
| 401 | Shelf | 402 | Adapter base |
| 403 | Adapter stone support | 404 | Engagement arm |
| 405 | Offset | 501 | Thin stone |
| 502 | Thick stone | 601 | Extended base |
| 503 | Offset space | 307 | Receiving space |
| 600 | Dual stone fixture | | |

DETAILED DESCRIPTION OF THE INVENTION THROUGH THE DRAWINGS

Figure 1:
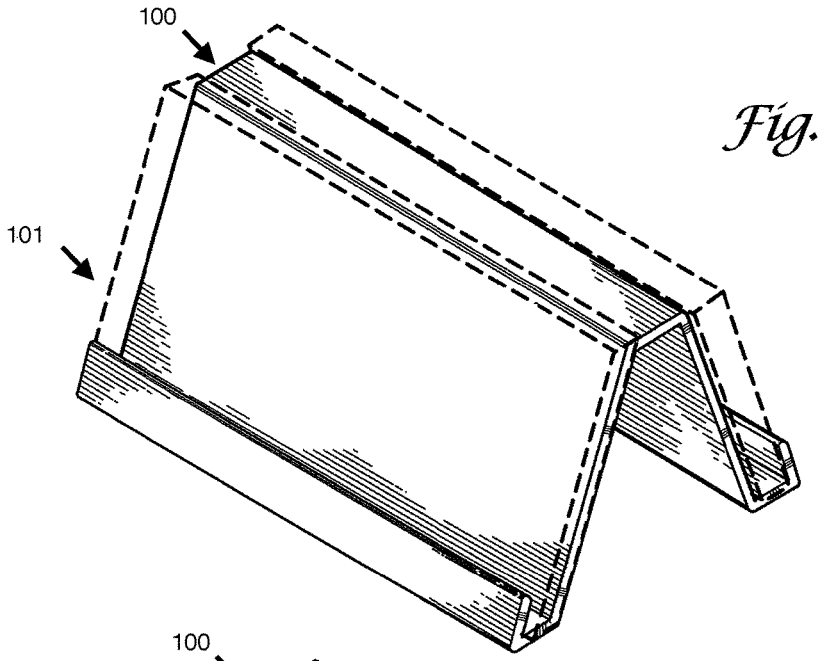
FIG. 1 is a perspective view of a prior art version of the present invention.
Figure 2:
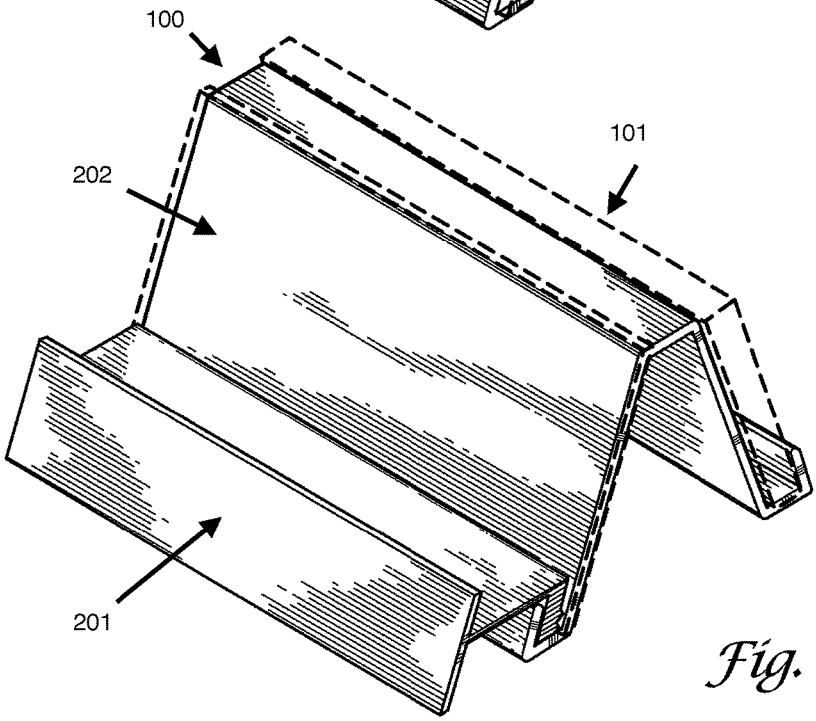
FIG. 2 is an perspective view of an implementation of the present invention.

Referring to FIG. 1, a prior art sharpening fixture 100 is shown. Disposed on fixture 100 are a pair of standard width sharpening stones 101. Referring to FIG. 2, fixture 100 is shown with one of the standard stones 101 removed and with the adapter 201 of the present invention shown engaged with fixture 100. As shown in FIG. 1, the prior art sharpening fixture 100 captures two equally thick sharpening stones 101.

Figure 3:
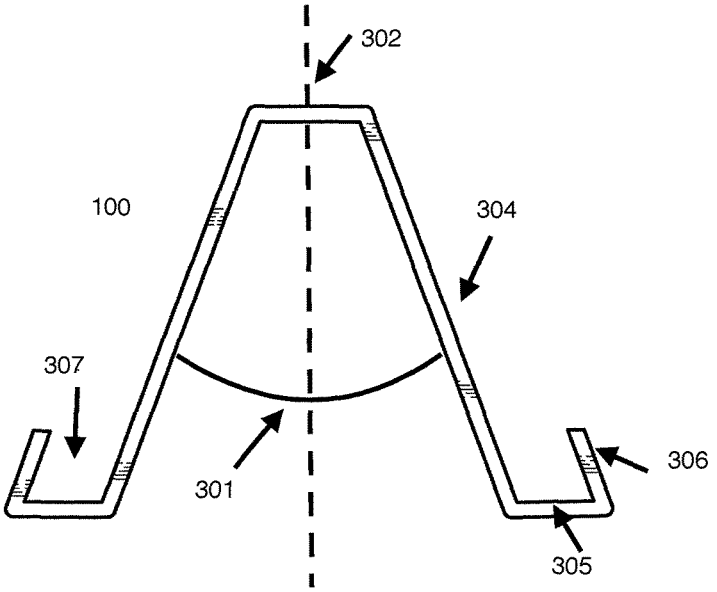
FIG. 3 is a side view of a prior art version of the present invention.

Referring to FIG. 3, a side view of the prior art fixture 100 is shown. Fixture 100 is a generally A-Frame shaped structure which is symmetrical about a vertical axis 302 and includes a support beam 303 at the top, a pair of angled legs 304 extending angledly downward and terminating in a pair of base supports 305 which bear on a work surface (not shown). Extending from each base 305 is stone support 306, which extends upward, parallel to each angled leg 304. Angled leg 304, base 305, and stone support 306 create a receiving space 307. Preferably, arc 301 is on the order of 40 degrees, thereby creating the preferred angle for sharpening a dental instrument.

Figure 4:
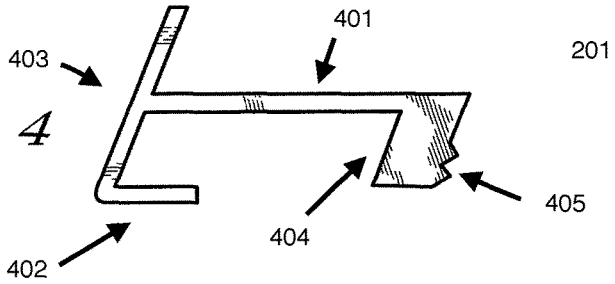
FIG. 4 is a side view of the insert of the present invention.

Referring to FIG. 4, the adapter 201 of the present invention is shown. Adapter 201 includes an engagement arm 404 that is sized to fit securely in receiving space 307. Engagement are 404 further includes a pair of offsets 405 that provide a secure connection in the receiving space 307. Extending horizontally from engagement are 404 is bearing shelf 401. Shelf 401 terminates into adapter stone support 403 which extends generally vertically (upward and downward) and parallel to angled leg 304. Adapter base 402 extends horizontally from the bottom of adapter stone support 403.

Figure 5:
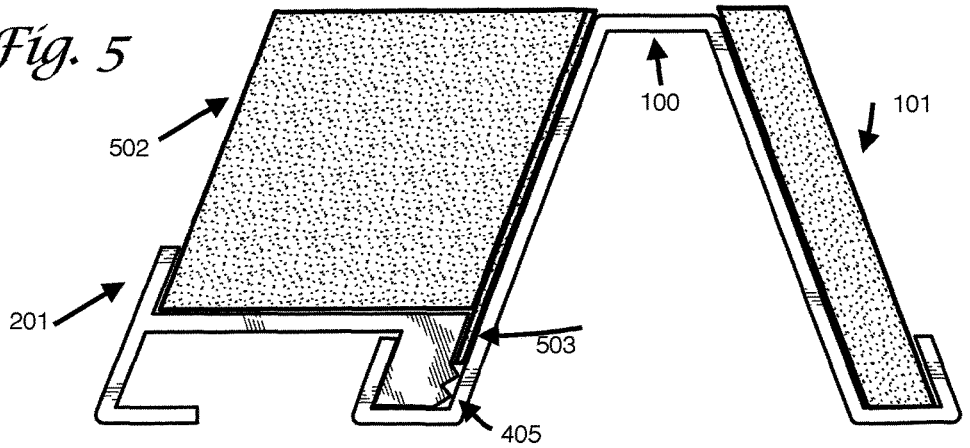
FIG. 5 is a side view of the fixture of the present invention showing sharpening stones and with the insert placed.

Referring to FIG. 5, adapter 201 is shown engaged with fixture 100. The horizontal length of shelf 401 defines the thickness of a sharpening stone that may be disposed. As is further shown, offsets 405 are sized to create an offset space 503 between angled leg 304 and engagement arm 404. FIG. 5 shows both a think stone 501 and a thick stone 502 disposed via adapter 201.

Figure 6:
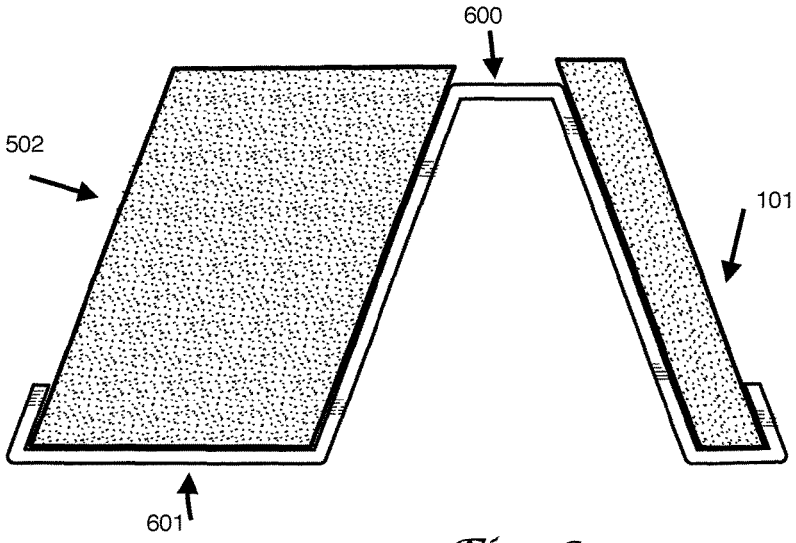
FIG. 6 is a side view of the fixture of the present invention with sharpening stones placed.

Referring to FIG. 6, an alternate embodiment is shown, dual stone fixture 600. In this embodiment, the dual stone fixture 600 includes an extended base 601 on one side thereby creating the ability to hold both a standard stone 101 and a thick stone 502.

Figure 7:
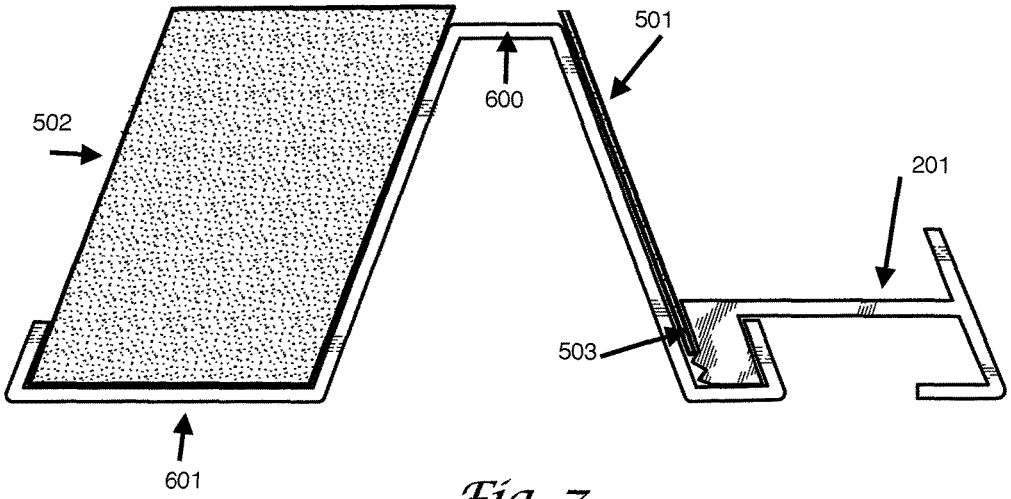
FIG. 7 is a side view of the fixture of the present invention with the insert placed.

Referring to FIG. 7, dual stone fixture 600 is shown with adapter 400 inserted on the standard stone side. Thin stone 501 is shown inserted into offset space 503 and bearing against angled leg 304.

In use, a user first selects the dental instrument to be sharpened. Next, the user determines the sharpening stone thickness (standard, thin, or thick) that best positions the selected dental instrument for sharpening.

It will be readily seen by one of ordinary skill in the art that the present invention fulfills all the objects set forth above. After reading the foregoing specification, one of ordinary skill will be able to effect various changes, substation of equivalents and various other aspects of the invention as broadly disclosed herein. It is, therefore, intended that the protection granted hereon be limited only by the definition contained in the appended claims and equivalents thereof.

What is claimed is:

1. An adapter for a dental instrument sharpening fixture comprising:

a. an engagement arm configured to slidingly engage a receiving space on said sharpening fixture, said engagement arm further including an offset feature;

b. a bearing shelf extending horizontally from said engagement arm and terminating in an upward and downward extending adapter stone support; and c. an adapter base extending horizontally from a lower end of said adapter stone support.

2. The adapter of claim 1 wherein said offset feature is comprised of a pair of sawtooth extensions.

3. The adapter of claim 1 wherein said offset feature creates a receiving space to capture a thin sharpening stone.

4. The adapter of claim 1 wherein said sharpening fixture is comprised of an A-frame shaped structure, symmetrical about a center line, and further including a top support beam, a pair of angled legs, a pair of base members, and a pair of stone support risers.

5. The adapter of claim 4 wherein said offset feature is comprised of a pair of sawtooth extensions.

6. The adapter of claim 4 wherein said offset feature creates a receiving space to capture a thin sharpening stone.

7. A fixture for sharpening dental instruments comprising:

a. a top support beam;

b. a first angled leg extending downward from a longitudinal edge of said support beam;

c. a second angled leg extending downward from a longitudinal edge of said support beam;

d. a first base member extending horizontally from said first angled leg;

e. a second base member extending horizontally from said second angled leg wherein said second base member is longer than said first base member;

f. a first riser extending upward from said first base member;

g. a second riser extending upward from said first base member h. wherein said first angled leg, said first base member, and said first riser define a first receiving space to receive a sharpening stone;

i. wherein said second angled leg, said second base member, and said second riser define a second receiving space to receive a sharpening stone; and j. wherein said second receiving space is configured to receive a thicker sharpening stone than said first receiving space.

8. The fixture of claim 7 further including an adapter for reducing the size of said first receiving space.

9. The fixture of claim 8 wherein said adapter is comprised of:

a. an engagement arm configured to slidingly engage said first receiving space on said fixture, said engagement arm further including an offset feature;

b. a bearing shelf extending horizontally from said engagement arm and terminating in an upward and downward extending adapter stone support; and c. an adapter base extending horizontally from a lower end of said adapter stone support.

* * * * *